US006261387B1

(12) United States Patent
Panchanathan

(10) Patent No.: US 6,261,387 B1
(45) Date of Patent: Jul. 17, 2001

(54) RARE-EARTH IRON-BORON MAGNET CONTAINING CERIUM AND LANTHANUM

(75) Inventor: Viswanathan Panchanathan, Anderson, IN (US)

(73) Assignee: Magnequench International, Inc., Anderson, IN (US)

( * ) Notice: Subject to any disclaimer, the term of this patent is extended or adjusted under 35 U.S.C. 154(b) by 0 days.

(21) Appl. No.: 09/405,239

(22) Filed: Sep. 24, 1999

(51) Int. Cl.[7] ..... H01F 1/057

(52) U.S. Cl. ..... 148/302; 252/62.54; 252/62.55; 75/244

(58) Field of Search ..... 148/302, 104; 252/62.54, 62.55; 75/244

(56) References Cited

U.S. PATENT DOCUMENTS

| | | | | |
|---|---|---|---|---|
| 4,765,848 | | 8/1988 | Mohri et al. . | |
| 4,770,723 | | 9/1988 | Sagawa et al. . | |
| 4,792,367 | | 12/1988 | Lee . | |
| 4,792,368 | | 12/1988 | Sagawa et al. . | |
| 4,844,754 | | 7/1989 | Lee . | |
| 4,902,361 | | 2/1990 | Lee et al. . | |
| 4,973,415 | * | 11/1990 | Ohmachi et al. | 148/302 |
| 5,129,963 | * | 7/1992 | Panchanathan et al. | 148/101 |
| 5,645,651 | | 7/1997 | Fujimura et al. . | |

* cited by examiner

*Primary Examiner*—John Sheehan
*Assistant Examiner*—Andrew L. Oltmans
(74) *Attorney, Agent, or Firm*—Pennie & Edmond LLP

(57) ABSTRACT

Permanent rare-earth magnets containing Ce are fabricated with coercivity greater than 4 kOe. One composition for such magnets is $[Ce_yR_{1-y}]_z(F_{1-v}B_v)_{1-z}$, where R is one or more rare-earth elements, F is Fe or Fe—Co, and the relative elemental atomic composition is $0.0<y\leqq 0.3$, $0.04\leqq z\leqq 0.25$, and $0.01\leqq v\leqq 0.30$. Another composition is $[(Ce_xLa_{1-x})_y R_{1-y}]_z(F_{1-v}B_v)_{1-z}$, with the relative elemental atomic composition $x<0.4$ or $0.9<x\leqq 1.0$ and $0.2\leqq y\leqq 0.8$, $0.04\leqq z\leqq 0.25$, and $0.01\leqq v\leqq 0.30$.

67 Claims, No Drawings

RARE-EARTH IRON-BORON MAGNET CONTAINING CERIUM AND LANTHANUM

FIELD OF THE INVENTION

The present invention relates to rare-earth iron-boron based permanent magnet compositions that include cerium and/or lanthanum.

BACKGROUND OF THE INVENTION

Rare earth-iron-boron based magnets, such as the well known Nd—Fe—B magnets, are used in numerous applications, including computer hardware, automobiles, consumer electronics and household appliances. In particular, magnets using rare earth elements, such as Nd or Pr, are useful primarily because of their superior magnetic properties, as manifested by their large coercivity, remanence, magnetization and maximum energy product. The primary disadvantage of such magnets is that because of the cost of scarce rare earth metals, such as Nd or Pr, they are relatively expensive to make.

Alternative, inexpensive permanent magnets, such as the ferrite-based magnets, which have long been available, generally exhibit poor magnetic properties as compared with rare earth based magnets. Thus, they are unsuitable for many applications. For example, the remanence of a permanent magnet fabricated from sintered ferrite is typically about 4.0 kG while the remanence for a bonded Nd—Fe—B magnet is about 6.5 kG. It would be useful to fabricate a bonded permanent magnet with a remanence that is intermediate between these values, of about 5.0 to 6.0 kG, which is sufficient for many applications for which ferrite magnets are unsuitable to use. In such cases, it would be particularly useful if such magnets could be fabricated at a lower cost than what is currently required for bonded Nd—Fe—B magnets.

U.S. Pat. No. 4,765,848 ("the Mohri patent") discloses a permanent magnet composition $[(Ce_xLa_{1-x})_yR_{1-y}]_z(Fe_{1-v}B_v)_{1-z}$ where R is one or more rare-earth elements, excluding Ce and La. In the disclosure of this patent, restrictions have been placed on the values of x, y, z and v: $0.4 \leqq x \leqq 0.9$; $0.2<y<1.0$; $0.05 \leqq z \leqq 0.3$; and $0.01 \leqq v \leqq 0.3$. With such limitations, the patent discloses that the coercivity of the resulting permanent magnet is greater than 4 kOe. This coercivity is viewed as an appropriate index for providing a useful magnet, and the patent teaches that the coercivity is insufficient when the values of the various constituents fall outside the ranges specified above.

One of the principal teachings of the Mohri patent is that there is a synergistic effect when both Ce and La are used in rare-earth iron-boron magnets. According to the teaching of the Mohri patent, both Ce and La, when used alone, decrease the magnetic properties, but when used togther, the synergistic effect acts to enhance the coercivity.

SUMMARY OF THE INVENTION

The present invention provides, contrary to the teachings of the Mohri patent, useful rare-earth iron-boron magnets where the amounts of the constituent elements are outside the ranges disclosed by the Mohri patent. Such permanent magnets exhibit adequate magnetic properties to make them useful in many applications. Moreover, permanent magnets in accordance with the present invention exhibit magnetic properties that fill in the gaps currently existing with available magnets of different compositions. As used herein, the term "permanent rare-earth magnet" includes a magnetic particle or magnetic powder, a bonded magnet made from such a magnetic particle or magnetic powder, and a fully dense isotropic or anisotropic magnet. All the compositions referred to herein are in atomic percent unless otherwise specified.

The present invention is directed to a permanent rare-earth magnet comprising an alloy having a composition expressed as $[(Ce_xLa_{1-x})_yR_{1-y}]_z(F_{1-v}B_v)_{1-z}$. In the composition, R is one or more rare-earth elements selected from the group consisting of Y, Pr, Nd, Sm, Er, Gd, Tb, Dy, Ho, Er, Tm, Yb, and Lu. F is Fe or Fe and up to 20 atomic percent Co by substitution. The subscripts denote the relative atomic composition with $0.9<x \leqq 1.0$, $0.2 \leqq y \leqq 0.8$, $0.04 \leqq z \leqq 0.25$, and $0.01 \leqq v \leqq 0.30$. This composition is outside the compositions disclosed in the Mohri patent. The permanent rare-earth magnet of the present invention may be a fully dense isotropic or anisotropic magnet, such as a sintered, hot-pressed, or hot-pressed and hot-worked magnet, or a bonded magnet. The process for making a sintered permanent rare earth magnet is well known and is described in, for example, U.S. Pat. Nos. 4,770,723, 4,792,368 and 5,645,651, which are incorporated herein by references. The process for making a hot-pressed magnet is also well known and is described in, for example, U.S. Pat. Nos. 4,792,367 and 4,844,754, where are incorporated herein by reference. The process for making a bonded magnet is well known and is described in, for example, U.S. Pat. No. 4,902,361, which is incorporated herein by reference. In a preferred embodiment, y is between approximately 0.35 and approximately 0.60. In another preferred embodiment, z is between approximately 0.10 and 0.18. In yet another preferred embodiment, v is between approximately 0.060 and 0.085. In one embodiment of the invention, the rare earth R is Nd. In another embodiment, R is $Nd_{1-w}Pr_w$, with the value of w preferably less than 0.30. In a further embodiment, R is $Nd_{1-t-t'}Pr_tR'_{t'}$, wherein R' is one or more elements selected from the group consisting of Nb and Ga.

The value of t is preferably less than 0.20 and the value of t, is preferably less than 0.1.

The invention is also directed to a permanent rare-earth magnet comprising an alloy having a composition expressed as $[Ce_yR_{1-y}]_z(F_{1-v}B_v)_{1-z}$. In this composition, R is one or more rare-earth elements selected from the group consisting of Y, Pr, Nd, Sm, Er, Gd, Tb, Dy, Ho, Er, Tm, Yb, and Lu. F is Fe or Fe and up to 20 percent Co by substitution. The subscripts denote the relative elemental composition with $0.0<y \leqq 0.3$, $0.04 \leqq z \leqq 0.25$, and $0.01 \leqq v \leqq 0.30$. This composition is outside the compositional ranges disclosed or taught by the Mohri patent because La is not present, except that it may be present as an impurity which is usually less than 0.1 atomic percent. In contradistinction, the Mohri patent teaches that La must be present in the composition in the amount greater than 0.1 atomic percent of the total amount of Ce and La. The permanent rare-earth magnet of the present invention may be a fully dense isotropic or anisotropic magnet. The permanent rare-earth magnet of the present invention may also be a bonded magnet.

In a preferred embodiment, the value of y is preferably less than approximately 0.2. In another preferred embodiment, z is preferably between approximately 0.10 and approximately 0.15. In yet another preferred embodiment, v is approximately 0.067. In another embodiment, the rare earth R is Nd. In still another embodiment, the rare earth R is $Nd_{1-w}Pr_w$. The value of w is preferably less than 0.30.

The invention is also directed to a permanent rare-earth magnet comprising an alloy having a composition expressed as $[(Ce_xLa_{1-x})_yR_{1-y}]_z(F_{1-v}B_v)_{1-z}$. In the composition, R is one or more rare-earth elements selected from the group consisting of Y, Pr, Nd, Sm, Er, Gd, Tb, Dy, Ho, Er, Tm, Yb, and Lu. F is Fe or Fe and up to 20 atomic percent Co by substitution. The subscripts denote the relative elemental composition with $0 \leqq x < 0.4$, $0.2 \leqq y \leqq 0.8$, $0.04 \leqq z \leqq 0.25$, and $0.01 \leqq v \leqq 0.30$. The permanent rare-earth magnet of the present invention may be a fully dense isotropic or anisotropic magnet, or a bonded magnet. The composition of the present invention is outside the compositional range (with $x > 0.4$) taught or suggested by the Mohri patent that would provide a good magnet.

In a preferred embodiment, x is less than approximately 0.01. The value of y is preferably between approximately 0.45 and approximately 0.55. The value of z is preferably between approximately 0.10 and approximately 0.18. The value of v is preferably between approximately 0.060 and 0.085. In one embodiment, the rare earth R is Nd. In another embodiment, the rare earth R is $Nd_{1-w}Pr_w$. The value of w is preferably less than 0.30. In a further embodiment, R is $Nd_{1-t-t'}Pr_tR'_{t'}$, wherein R' is Nb and/or Ga. The value of t is preferably less than 0.20 and the value of t' is preferably less than 0.1.

DETAILED DESCRIPTION OF THE INVENTION

Contrary to the teaching of the Mohri patent that a combination of Ce and La is needed to produce rare-earth iron-boron magnets with sufficiently good magnetic properties, the present invention provides that a high coercivity can be achieved with the addition of Ce alone. The results of a series of experiments illustrating this are presented in Table I.

TABLE I

| COMPOSITION (at. %) | | | | |
|---|---|---|---|---|
| Nd | Ce | B | Fe | INTRINSIC COERCIVITY (kOe) |
| 13.5 | 0.0 | 6.0 | 80.5 | 14.40 |
| 12.6 | 0.9 | 6.0 | 80.5 | 14.69 |
| 11.7 | 1.8 | 6.0 | 80.5 | 13.60 |
| 11.3 | 2.3 | 6.0 | 80.4 | 13.70 |
| 9.9 | 3.7 | 6.0 | 80.4 | 12.90 |
| 12.5 | 0.0 | 5.9 | 81.6 | 9.49 |
| 11.6 | 0.9 | 5.9 | 81.6 | 9.48 |
| 10.7 | 1.8 | 5.9 | 81.6 | 9.42 |
| 9.8 | 2.7 | 5.9 | 81.6 | 10.00 |
| 11.4 | 0.0 | 5.9 | 82.7 | 7.30 |
| 10.5 | 0.9 | 5.9 | 82.7 | 7.35 |
| 9.6 | 1.8 | 5.9 | 82.7 | 6.66 |

The table shows three sets of experiments involving magnets made with the composition $Nd_uCe_wB_qFe_{100-u-w-q}$, in which u, w and q represent the atomic percentage of Nd, Ce and B, respectively. In each of the three sets of experiments, magnets were prepared with increasing amounts of Ce. A control magnet that was purely Nd—B—Fe without any Ce was also prepared for each set.

In order to form the magnets, alloys with the requisite concentrations were prepared in an arc melter and melt spun into ribbon to an overquenched condition. They were then subsequently annealed to obtained the properties given in the table. For each of the magnets thus formed, the intrinsic coercivity was measured and tabulated for the differing values of u, w and q.

It is noted that where the composition is represented by the chemical formula $[(Ce_xLa_{1-x})_yR_{1-y}]_z(Fe_{1-v}B_v)_{1-z}$, the experiments were performed for $x=1.0$, $0.0 \leqq y < 0.3$, $v=0.067$, and $0.10 \leqq z \leqq 0.15$. This composition is considered by the Mohri patent to produce magnets with poor magnetic properties. The experimental results in accordance with the present invention, however, are contrary to this teaching of Mohri. Although it is true that the intrinsic coercivity shows a general trend of being inversely related to the concentration of Ce when Ce is added alone, there is a greater effect on the intrinsic coercivity that results from the Nd concentration.

For example, the greatest adverse effect on the coercivity resulting from an increase in the Ce concentration is shown in the third set of experiments. Here, an increase in the Ce concentration from 0.0 to 15.8% (as a fraction of the total rare earth atomic concentration) results in a decrease of the intrinsic coercivity by 8.8%. The other two sets of experiments show an even smaller adverse effect on the intrinsic coercivity resulting from an increase in Ce concentration. This result should be compared with the effect on the intrinsic coercivity caused solely by the decrease in Nd concentration, uncompensated by a corresponding increase in Ce concentration. A decrease in Nd concentration (of the total alloy composition) from 13.5% to 12.5% results in a decrease in intrinsic coercivity of 34.1%, and a further decrease in Nd concentration to 11.4% results in a total decrease in intrinsic coercivity of 49.3%.

It is thus apparent that the primary effect on the magnetic properties of the resulting magnets is due to the total rare-earth concentration. The inclusion of Ce to compensate for what would otherwise be a decrease in this total rare-earth concentration due to a reduction in Nd acts to mitigate the negative effects on these magnetic properties. A brief examination of Table 1 shows that even in the worst case studied the additional Ce nevertheless resulted in a magnet with an intrinsic coercivity well above the index value of 4 kOe established in the Mohri patent as indicating good magnetic properties.

These studies thus demonstrate that, contrary to the teaching of the Mohri patent, the addition of Ce alone to a rare-earth iron-boron magnet results in only a modest effect on the magnet's magnetic properties. The produced magnets may still have a high coercivity that is useful for many practical applications. Given the very different cost for Nd and Ce, the availability of magnets where some fraction of Nd has been substituted by Ce is of considerable importance. Especially in commercial applications, the present invention thus provides permanent rare-earth iron-boron magnets with good magnetic properties at a substantial savings. For example, it is possible to add La and Ce as misch metal, which is significantly less costly than Nd. As is also evident from the presented experimental results, in accordance with the present invention, magnets with intermediate values of the intrinsic coercivity are provided by adjusting the relative concentration of Nd and Ce, which permits the production of magnets with magnetic properties more precisely defined for specific desired applications.

The results of a second series of experiments are presented in Table II. In this second series of experiments, both Ce and La were added to form alloys where their combined concentration is between 35% and 60% of the total rare-earth concentration. In Table IIa the values of x, y, z, and v are displayed for each of the corresponding samples in Table II, here the composition is written $[(Ce_xLa_{1-x})_yR_{1-y}]_z(Fe_{1-v}B_v)_{1-z}$.

In Table II, TRE represents the total amount of rare earth elements, including, but not limited to, Nd, Pr, La, Ce, and Dy.

TABLE II

| | COMPOSITION (at.%) | | | | | | | PROPERTIES (POWDER) | | |
|---|---|---|---|---|---|---|---|---|---|---|
| ID | Nd | Pr | La | Ce | TRE | B | Others | Br(kG) | Hci(kOe) | BH(MGOe) |
| 1 | 5.6 | 1.1 | 0.5 | 7.4 | 14.6 | 6.1 | | 6.22 | 11.4 | 7.72 |
| 2 | 5.4 | 1.0 | 0.4 | 7.1 | 13.95 | 6.1 | 0.6 Nb | 6.47 | 12.9 | 8.54 |
| 3 | 5.4 | 1.0 | 0.4 | 7.1 | 14.0 | 6.0 | 0.47 Ga | 6.33 | 13.6 | 8.11 |
| 4 | 5.3 | 0.9 | 0.45 | 4.85 | 11.5 | 6.4 | | 6.61 | 6.09 | 6.39 |
| 5 | 5.4 | 0.9 | 0.4 | 4.8 | 11.5 | 5.8 | | 6.90 | 6.65 | 7.50 |
| 6 | 5.3 | 1.1 | 0.5 | 5.4 | 12.3 | 5.9 | 0.46 Ga | 6.93 | 7.38 | 8.09 |
| 7 | 5.5 | 1.1 | 0.4 | 5.0 | 12.4 | 5.9 | 0.48 Nb | 7.03 | 7.94 | 8.82 |
| 8 | 5.5 | 1.0 | 0.4 | 5.3 | 12.3 | 5.9 | | 6.74 | 7.19 | 7.22 |
| 9 | 5.6 | 1.0 | 0.4 | 3.9 | 10.9 | 5.8 | | 6.66 | 4.39 | 5.60 |
| 10 | 6.1 | 1.1 | 0.5 | 6.0 | 14.1 | 6.0 | | 6.50 | 11.7 | 8.36 |
| 11 | 5.9 | 1.1 | 0.5 | 6.0 | 13.5 | 6.0 | | 6.70 | 9.70 | 8.58 |
| 12 | 5.5 | 1.1 | 0.4 | 6.5 | 13.5 | 6.6 | | 6.68 | 11.1 | 8.70 |
| 13 | 5.7 | 1.1 | 0.4 | 6.9 | 14.1 | 6.6 | | 6.39 | 11.1 | 8.11 |
| 14 | 5.8 | 0.05 | 6.1 | 0.05 | 12.1 | 5.3 | | 5.24 | 4.36 | 3.14 |
| 15 | 7.3 | 0.1 | 6.55 | 0.05 | 14.0 | 6.0 | | 6.54 | 6.14 | 5.85 |
| 16 | 6.05 | 0.05 | 6.85 | 0.05 | 13.0 | 5.9 | | 5.87 | 4.61 | 3.99 |
| 17 | 7.4 | 0.05 | 7.3 | 0 | 14.75 | 6.7 | | 6.70 | 6.73 | 6.91 |
| 18 | 6.8 | 0.05 | 8.3 | 0.05 | 15.2 | 6.1 | | 6.28 | 5.76 | 5.43 |
| 19 | 7.7 | 0.05 | 8.3 | 0.05 | 16.1 | 6.8 | | 6.80 | 7.16 | 7.54 |
| 20 | 6.1 | 0.05 | 0.1 | 7.6 | 13.85 | 6.6 | | 4.88 | 7.49 | 3.73 |
| 21 | 5.8 | 0.05 | 0.1 | 7.3 | 13.25 | 5.4 | | 6.02 | 7.08 | 5.66 |
| 22 | 6.9 | 0.05 | 0.1 | 6.7 | 13.75 | 7.2 | | 6.32 | 9.79 | 7.69 |
| 23 | 6.7 | 0.05 | 0.05 | 7.3 | 14.1 | 7.2 | | 6.32 | 10.7 | 8.00 |
| 24 | 5.8 | 0.05 | 0.1 | 5.8 | 11.8 | 6.4 | | 5.72 | 8.23 | 4.96 |
| 25 | 5.7 | 0.05 | 0.05 | 5.8 | 11.6 | 5.8 | | 5.70 | 5.98 | 4.37 |
| 26 | 6.0 | 0.05 | 0.05 | 6.3 | 12.45 | 5.9 | | 6.49 | 8.75 | 7.99 |
| 27 | 6.4 | 0.1 | 0.05 | 6.5 | 13.1 | 6.5 | | 5.89 | 7.43 | 5.72 |
| 28 | 6.55 | 0.1 | 0.05 | 6.1 | 12.85 | 5.9 | | 6.20 | 7.28 | 6.54 |
| 29 | 6.6 | 0.05 | 0.1 | 7.0 | 13.85 | 6.0 | | 6.18 | 9.75 | 7.48 |

TABLE IIa

| ID | x | y | z | v |
|---|---|---|---|---|
| 1 | 0.937 | 0.541 | 0.146 | 0.071 |
| 2 | 0.947 | 0.540 | 0.1395 | 0.071 |
| 3 | 0.947 | 0.540 | 0.140 | 0.070 |
| 4 | 0.915 | 0.461 | 0.115 | 0.072 |
| 5 | 0.923 | 0.452 | 0.115 | 0.066 |
| 6 | 0.915 | 0.480 | 0.123 | 0.067 |
| 7 | 0.926 | 0.450 | 0.124 | 0.067 |
| 8 | 0.930 | 0.467 | 0.123 | 0.067 |
| 9 | 0.907 | 0.394 | 0.109 | 0.065 |
| 10 | 0.923 | 0.474 | 0.141 | 0.070 |
| 11 | 0.923 | 0.481 | 0.135 | 0.069 |
| 12 | 0.942 | 0.511 | 0.135 | 0.076 |
| 13 | 0.945 | 0.518 | 0.141 | 0.077 |
| 14 | 0.008 | 0.513 | 0.121 | 0.060 |
| 15 | 0.008 | 0.471 | 0.140 | 0.070 |
| 16 | 0.007 | 0.531 | 0.130 | 0.068 |
| 17 | 0.000 | 0.495 | 0.1475 | 0.079 |
| 18 | 0.006 | 0.549 | 0.152 | 0.072 |
| 19 | 0.006 | 0.519 | 0.161 | 0.081 |
| 20 | 0.987 | 0.556 | 0.1385 | 0.077 |
| 21 | 0.986 | 0.558 | 0.1325 | 0.062 |
| 22 | 0.985 | 0.495 | 0.1375 | 0.084 |
| 23 | 0.993 | 0.521 | 0.141 | 0.084 |
| 24 | 0.983 | 0.502 | 0.118 | 0.072 |
| 25 | 0.991 | 0.504 | 0.116 | 0.066 |
| 26 | 0.992 | 0.512 | 0.1245 | 0.067 |
| 27 | 0.992 | 0.502 | 0.131 | 0.075 |
| 28 | 0.992 | 0.480 | 0.1285 | 0.068 |
| 29 | 0.986 | 0.516 | 0.1385 | 0.070 |

As can be seen from Tables II and IIa, contrary to the teaching of the Mohri patent, there are primarily two compositional regions outside of the ranges taught or suggested by Mohri within which magnetic powders having sufficiently good magnetic properties may be obtained.

First, the present invention provides magnets having an intrinsic coercivity above 4 kOe where the relative concentration of Ce is greater than 0.9 of the total Ce—La concentration. As shown for Sample 9, with a value of x=0.907, a coercivity of 4.39 kOe results. The examples shown in Table II supplement the previous results for x=1.0, showing that the Ce concentrations in the entire region $0.9<x\leqq 1.0$ may be used to form high-quality magnets. In this region, the relative Ce-La concentration with respect to the total rare-earth concentration lies within the limits $0.35\leqq y\leqq 0.60$.

Second, Table IIa also shows results for very low values of x in Samples 14–19. As shown in the Table, the present invention provides magnetic powders with the desired magnetic properties even for such very low Ce concentrations. Sample 17 is an example where there is no Ce present.

Furthermore, in accordance with the present invention, additives, such as Ga or Nb, may be included in the composition to change or improve the magnetic properties of the resulting powders. Samples 2, 3, 6, and 7 include Nb or Ga additives. Provided that the total composition of Ce and La remains within the range of 35% to 60% of the total rare earth, the magnetic properties of the powders may be adjusted by the use of appropriate additives such as Ga or Nb.

It should be apparent to those skilled in the art that minor amounts of other elements, such as W, Cr, Ni, Al, Cu, Mg, Mn, V, Mo, Ti, Ta, Zr, C, Sn, and Ca, may be present in the composition without substantially adversely affect the magnetic properties of the resulting magnets. Preferably, the amounts of these elements, either alone or in combination, do not exceed 2 percent of the composition. In addition, small amounts of Si, O and N may also be present in the composition.

Although the present invention has been described with reference to examples, it will be appreciated by those of ordinary skill in the art that modifications can be made to the structure and form of the invention without departing from its spirit and scope, which is defined in the following claims.

What is claimed is:

1. A permanent rare-earth magnet having a composition expressed as $[(Ce_xLa_{1-x})_yR_{1-y}]_z(F_{1-v}B_v)_{1-z}$, wherein R is one or more rare-earth elements selected from the group consisting of Y, Pr, Nd, Sm, Er, Gd, Tb, Dy, Ho, Er, Tm, Yb, and Lu;

wherein F is Fe or Fe and up to 20 atomic percent Co by substitution; and wherein subscripts denote the relative elemental atomic composition with $0.9<x\leqq1.0$, $0.2\leqq y\leqq0.8$, $0.04\leqq z\leqq0.16$, and $0.01<v<0.30$ said magnet having an intrinsic coercivity of above 4 kOe.

2. A permanent rare-earth magnet according to claim 1, wherein y is between approximately 0.35 and approximately 0.60.

3. A permanent rare-earth magnet according to claim 1, wherein z is between approximately 0.10 and approximately 0.16.

4. A permanent rare-earth magnet according to claim 1, wherein v is between approximately 0.060 and 0.085.

5. A permanent rare-earth magnet according to claim 1, wherein R is Nd.

6. A permanent rare-earth magnet according to claim 1, wherein v is $Nd_{1-w}Pr_w$.

7. A permanent rare-earth magnet according to claim 6, wherein $w<0.30$.

8. A permanent rare-earth magnet according to claim 1, wherein R is $Nd_{1-t-t'}Pr_tR'_{t'}$, and wherein R' is one or more elements selected from the group consisting of Nb and Ga.

9. A permanent rare-earth magnet according to claim 8, wherein $t<0.20$ and $t'<0.1$.

10. A permanent rare-earth magnet having a composition expressed as $[(Ce_xLa_{1-x})_yR_{1-y}]_z(F_{1-v}B_v)_{1-z}$, wherein R is one or more rare-earth elements selected from the group consisting of Y, Pr, Nd, Sm, Er, Gd, Tb, Dy, Ho, Er, Tm, Yb, and Lu;

wherein F is Fe or Fe and up to 20 atomic percent Co by substitution; and wherein subscripts denote the relative elemental atomic composition with $0\leqq x<0.4$, $0.2\leqq y\leqq0.8$, $0.04\leqq z\leqq0.16$, and $0.01\leqq v\leqq0.30$ said magnet having an intrinsic coercivity of above 4 kOe.

11. A permanent rare-earth magnet according to claim 10, wherein x is less than approximately 0.01.

12. A permanent rare-earth magnet according to claim 10, wherein y is between approximately 0.45 and approximately 0.55.

13. A permanent rare-earth magnet according to claim 10, wherein z is between approximately 0.10 and approximately 0.16.

14. A permanent rare-earth magnet according to claim 10, wherein v is between approximately 0.060 and 0.085.

15. A permanent rare-earth magnet according to claim 10, wherein $0.45<y<0.55$, $0.10\leqq z\leqq0.16$, and $0.060<v<0.085$.

16. A permanent rare-earth magnet according to claim 10, wherein R is Nd.

17. A permanent rare-earth magnet according to claim 10, wherein R is $Nd_{1-w}Pr_w$.

18. A permanent rare-earth magnet according to claim 17, wherein $w<0.30$.

19. A permanent rare-earth magnet according to claim 10, wherein R is $Nd_{1-t-t'}Pr_tR'_{t'}$, and wherein R' is Nb and/or Ga.

20. A permanent rare-earth magnet according to claim 19, wherein $t<0.20$ and $t'<0.1$.

21. A permanent bonded rare-earth magnet comprising an alloy having a composition expressed as $[(CeLa_{1-x})_yR_{1-y}]_z(F_{1-v}B_v)_{1-z}$, wherein R is one or more rare-earth elements selected from the group consisting of Y, Pr, Nd, Sm, Er, Gd, Tb, Dy, Ho, Er, Tm, Yb, and Lu;

wherein F is Fe or Fe and up to 20 atomic percent Co by substitution; and wherein subscripts denote the relative elemental atomic composition with $0.9<x\leqq1.0$, $0.2\leqq y\leqq0.8$, $0.04\leqq z\leqq0.16$, and $0.01\leqq v-0.30$ said magnet having an intrinsic coercivity of above 4 kOe.

22. A permanent bonded rare-earth magnet according to claim 21, wherein y is between approximately 0.35 and approximately 0.60.

23. A permanent bonded rare-earth magnet according to claim 21, wherein z is between approximately 0.10 and approximately 0.16.

24. A permanent bonded rare-earth magnet according to claim 21, wherein v is between approximately 0.060 and 0.085.

25. A permanent bonded rare-earth magnet according to claim 21, wherein R is Nd.

26. A permanent bonded rare-earth magnet according to claim 21, wherein R is $Nd_{1-w}Pr_w$.

27. A permanent bonded rare-earth magnet according to claim 26, wherein $w<0.30$.

28. A permanent bonded rare-earth magnet according to claim 21, wherein R is $Nd_{1-t-t'}Pr_tR'_{t'}$, and wherein R' is one or more elements selected from the group consisting of Nb and Ga.

29. A permanent bonded rare-earth magnet according to claim 28, wherein $t<0.20$ and $t'<0.1$.

30. A permanent fully dense isotropic or anisotropic rare-earth magnet comprising an alloy having a composition expressed as $[(Ce_xLa_{1-x})_yR_{1-y}]_z(F_{1-v}B_v)_{1-z}$, wherein R is one or more rare-earth elements selected from the group consisting of Y, Pr, Nd, Sm, Er, Gd, Tb, Dy, Ho, Er, Tm, Yb, and Lu;

wherein F is Fe or Fe and up to 20 atomic percent Co by substitution; and wherein subscripts denote the relative elemental atomic composition with $0.9<x\leqq1.0$, $0.2\leqq y\leqq0.8$, $0.04\leqq z\leqq0.16$, and $0.01\leqq v\leqq0.30$ said magnet having an intrinsic coercivity of above 4 kOe.

31. A Permanent fully dense rare-earth magnet according to claim 30, wherein y is between approximately 0.35 and approximately 0.60.

32. A permanent fully dense rare-earth magnet according to claim 30, wherein z is between approximately 0.10 and approximately 0.16.

33. A permanent fully dense rare-earth magnet according to claim 30, wherein v is between approximately 0.060 and 0.085.

34. A permanent fully dense rare-earth magnet according to claim 30, wherein R is Nd.

35. A permanent fully dense rare-earth magnet according to claim 30, wherein R is $Nd_{1-w}Pr_w$.

36. A permanent fully dense rare-earth magnet according to claim 35, wherein w<0.30.

37. A permanent fully dense rare-earth magnet according to claim 30, wherein R is $Nd_{1-t-t'}Pr_tR'_{t'}$, and wherein R' is one or more elements selected from the group consisting of Nb and Ga.

38. A permanent fully dense rare-earth magnet according to claim 37, wherein t<0.20 and t'<0.1.

39. A permanent bonded rare-earth magnet comprising an alloy having a composition expressed as $[Ce_yR_{1-y}]_z(F_{1-v}B_v)_{1-z}$, wherein R is one or more rare-earth elements selected from the group consisting of Y, Pr, Nd, Sm, Er, Gd, Tb, Dy, Ho, Er, Tm, Yb, and Lu;

wherein F is Fe or Fe and up to 20 atomic percent Co by substitution; and wherein subscript denote the relative elemental atomic composition with 0.12<y<0.3

$0.04 \leqq z < 0.16$, and $0.01 \leqq v \leqq 0.30$.

40. A permanent bonded rare-earth magnet according to claim 39, wherein y is less than approximately 0.2.

41. A permanent bonded rare-earth magnet according to claim 39, wherein z is between approximately 0.10 and approximately 0.15.

42. A permanent bonded rare-earth magnet according to claim 39, wherein v is approximately 0.067.

43. A permanent bonded rare-earth magnet according to claim 39, wherein R is Nd.

44. A permanent bonded rare-earth magnet according to claim 39, wherein R is $Nd_{1-w}Pr_w$.

45. A permanent bonded rare-earth magnet according to claim 44, herein w<0.30.

46. A permanent bonded rare-earth magnet comprising an alloy having a composition expressed as $[(Ce_xLa_{1-x})_yR_{1-y}]_z(F_{1-v}B_v)_{1-z}$, wherein R is one or more rare-earth elements selected from the group consisting of Y, Pr, Nd, Sm, Er, Gd, Tb, Dy, Ho, Er, Tm, Yb, and Lu;

wherein F is Fe or Fe and up to 20 atomic percent Co by substitution; and wherein subscripts denote the relative elemental atomic composition with $0 \leqq x < 0.4$, $0.2 \leqq y \leqq 0.8$, $0.04 \leqq z \leqq 0.16$, and $0.01 \leqq v \leqq 0.30$ said magnet having an intrinsic coercivity of above 4 kOe.

47. A permanent bonded rare-earth magnet according to claim 46, wherein x is less than approximately 0.01.

48. A permanent bonded rare-earth magnet according to claim 46, wherein y is between approximately 0.45 and approximately 0.55.

49. A permanent bonded rare-earth magnet according to claim 46, wherein z is between approximately 0.10 and approximately 0.16.

50. A permanent bonded rare-earth magnet according to claim 46, wherein v is between approximately 0.060 and 0.085.

51. A permanent bonded rare-earth magnet according to claims wherein $0.45<y<0.55$, $0.10 \leqq z < 0.16$, and $0.060<v<0.085$.

52. A permanent bonded rare-earth magnet according to claim 46, wherein R is Nd.

53. A permanent bonded rare-earth magnet according to claim 46, wherein R is $Nd_{1-w}Pr_w$.

54. A permanent bonded rare-earth magnet according to claim 53, wherein w<0.30.

55. A permanent bonded rare-earth magnet according to claim 46, wherein R is $Nd_{1-t-t'}Pr_tR'_{t'}$, and wherein R' is Nb and/or Ga.

56. A permanent bonded rare-earth magnet according to claim 55, wherein t<0.20 and t'<0.1.

57. A permanent fully dense isotropic or anisotropic rare-earth magnet comprising an alloy having a composition expressed as $[(Ce_xLa_{1-x})_yR_{1-y}]_z(F_{1-v}B_v)_{1-z}$, wherein R is one or more rare-earth elements selected from the group consisting of Y, Pr, Nd, Sm, Er, Gd, Tb, Dy, Ho, Er, Tm, Yb, and Lu;

wherein F is Fe or Fe and up to 20 atomic percent Co by substitution; and wherein subscripts denote the relative elemental atomic composition with $0 \leqq x < 0.4$, $0.2 \leqq y \leqq 0.8$, $0.04 \leqq z \leqq 0.16$, and $0.01 \leqq v \leqq 0.30$ said magnet having an intrinsic coercivity of above 4 kOe.

58. A permanent fully dense rare-earth magnet according to claim 57, wherein x is less than approximately 0.01.

59. A permanent fully dense rare-earth magnet according to claim 57, wherein y is between approximately 0.45 and approximately 0.55.

60. A permanent fully dense rare-earth magnet according to claim 50, wherein z is between approximately 0.10 and approximately 0.16.

61. A permanent fully dense rare-earth magnet according to claim 57, wherein v is between approximately 0.060 and 0.085.

62. A permanent fully dense rare-earth magnet according to claim 57, wherein $0.45<y<0.55$, $0.10<z<0.16$, and $0.060<v<0.085$.

63. A permanent fully dense rare-earth magnet according to claim 57, wherein R is Nd.

64. A permanent fully dense rare-earth magnet according to claim 57, wherein R is $Nd_{1-w}Pr_w$.

65. A permanent fully dense rare-earth magnet according to claim 64, wherein w<0.30.

66. A permanent fully dense rare-earth magnet according to claim 57, wherein R is $Nd_{1-t-t'}Pr_tR'_{t'}$, and wherein R' is Nb and/or Ga.

67. A permanent fully dense rare-earth magnet according to claim 66, wherein t<0.20 and t'<0.1.

* * * * *

UNITED STATES PATENT AND TRADEMARK OFFICE

CERTIFICATE OF CORRECTION

PATENT NO. : 6,261,387 B1 
DATED : July 17, 2001
INVENTOR(S) : Viswanathan Panchanathan It is certified that error appears in the above-identified patent and that said Letters Patent is hereby corrected as shown below:

Column 8,
Lines 8-9, delete "$[(CeLa_{1-x})_yR_{1-y}]_z(F_{1-v}B_v)_{1-z}$," and insert
-- $[(Ce_xLa_{1-x})_yR_{1-y}]_z(F_{1-v}B_v)_{1-z}$, --.

Signed and Sealed this

Tenth Day of December, 2002

JAMES E. ROGAN
*Director of the United States Patent and Trademark Office*